US005447280A

United States Patent [19]

Feathers

[11] Patent Number: 5,447,280

[45] Date of Patent: Sep. 5, 1995

[54] FALL-ARREST SAFETY ANCHORAGES

[75] Inventor: Leonard J. Feathers, Ty Croes, United Kingdom

[73] Assignee: Barrow Hepburn Sala Ltd., Portishead, United Kingdom

[21] Appl. No.: 153,104

[22] Filed: Nov. 17, 1993

Related U.S. Application Data

[62] Division of Ser. No. 920,383, Aug. 19, 1992, Pat. No. 5,351,906.

[30] Foreign Application Priority Data

Dec. 21, 1990 [GB] United Kingdom ..... 9027783

[51] Int. Cl.[6] ..... A62B 1/10

[52] U.S. Cl. ..... 242/381.5; 242/396.6; 182/237; 182/239

[58] Field of Search ..... 242/396.6, 371, 379, 242/381.5; 182/237, 239; 254/267

[56] References Cited

U.S. PATENT DOCUMENTS

| | | | |
|---|---|---|---|
| 2,546,202 | 3/1951 | Trouin | 254/153 |
| 4,198,033 | 4/1980 | Messuziere et al. | 254/159 |
| 4,511,123 | 4/1985 | Ostrobrod | 254/364 |
| 4,846,313 | 7/1989 | Sharp | 188/187 |
| 5,351,906 | 10/1994 | Feathers | 242/396.6 |

FOREIGN PATENT DOCUMENTS

| | | |
|---|---|---|
| 2165763 | 8/1973 | France . |
| 851981 | 10/1960 | United Kingdom . |
| 1463589 | 2/1977 | United Kingdom . |
| 1552667 | 9/1979 | United Kingdom . |

*Primary Examiner*—John Q. Nguyen

*Attorney, Agent, or Firm*—Dennison, Meserole, Pollack & Scheiner

[57] ABSTRACT

A fall-arrest safety anchorage has a safety line drum (10) and braking components assembled to a spine plate (1). The braking components comprise a rotatable brake component (2) and fixed brake components (1,7) one of which is constituted by the spine plate. The rotatable brake component (2) constitutes the driven member of a centrifugal clutch comprising coupling elements (17) which are mounted on the drum and become centrifuged into engagement with abutments (16) on the rotatable brake element if the unwinding speed of the drum exceeds a predetermined value. The rotation of the brake component (2) takes place against a frictional resistance imparted by friction rings (5,6) which are sandwiched under pressure between the rotatable brake component and the fixed brake components (1,7).

17 Claims, 6 Drawing Sheets

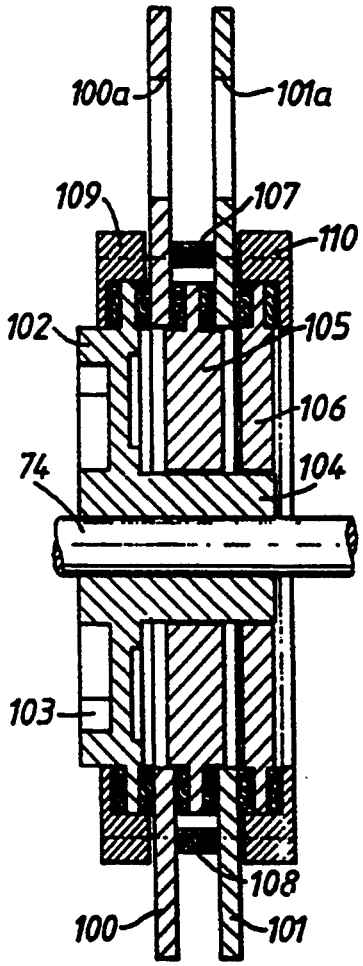
Fig.10.
Fig.11.
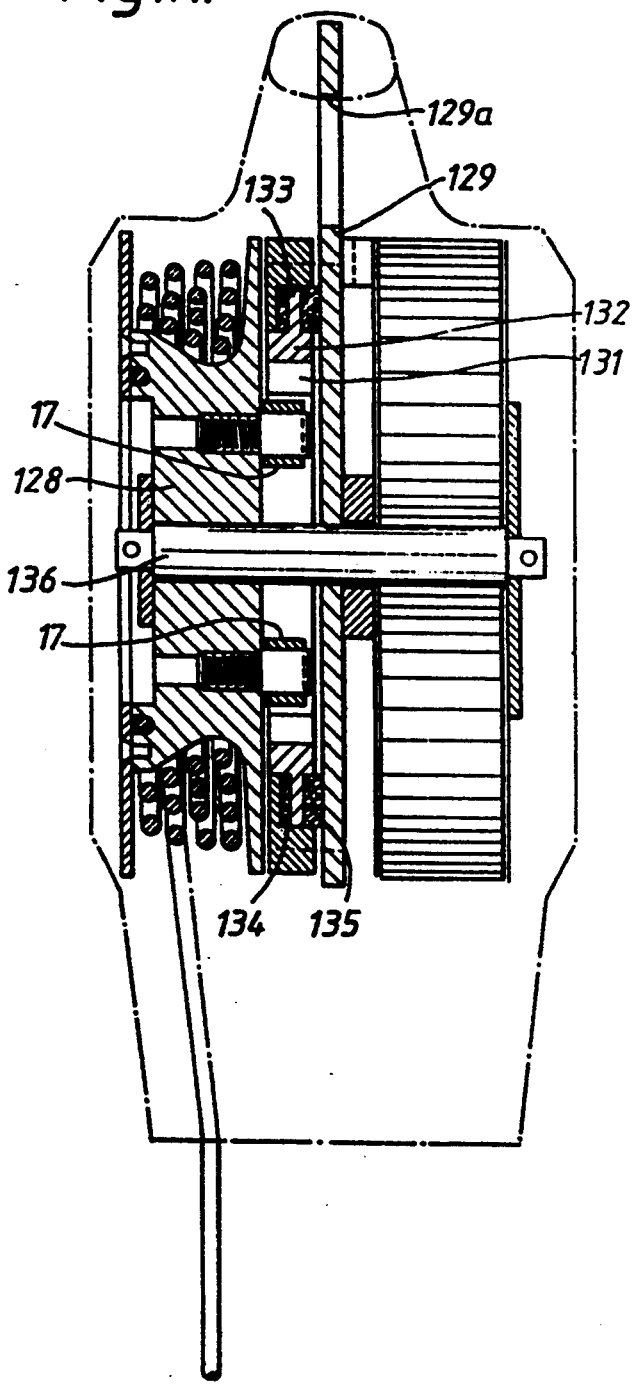

FALL-ARREST SAFETY ANCHORAGES

This is a divisional of application Ser. No. 07/920,383, filed Aug. 19, 1992 U.S. Pat. No. 5,351,906.

This invention relates to safety anchorages for controlling pay-out of a safety line during descent of a body attached to such line.

The invention has been made with particular reference to personnel safety anchorages for use by persons working at height and the invention will be more particularly described in that context. However the safety line of anchorages according to the invention can of course be attached to any body, whether animate or inanimate.

The invention is applicable to different kinds of safety anchorages. One such kind comprises fall-arrest anchorages which permit a worker attached to the safety line to climb or descend from one level to another in course of his work but which are self-locking in the event of excessive pay-out speed of the safety line such as would occur if the worker should begin to fall. Another such kind comprises anchorages which control the descent of a person under his or her own weight and which can be used as a means of escape from an elevated position in the case of fire or other emergency circumstance. Fall-arrest anchorages normally incorporate a self-winding drum from which the safety line pays out as required by the movements of the person attached to the line. Safety anchorages of the descent control type normally comprise a safety line which is guided around a sheave as it pays out through the anchorage. As one end of the line descends the opposite end of the line rises and if another person then becomes attached to that opposite end of the line the anchorage can function in the same manner, but in a reverse sense, to control the descent of that other person.

Such safety anchorages essentially comprise a rotatable safety line carrier or guide which is driven by the safety line as it pays out, and a brake mechanism which prevents excessive pay-out speed. The safety line is conventionally in the form of a rope or cable.

Safety anchorages are known wherein the rotatable safety line carrier or guide and the brake mechanism are enclosed and carried by a casing whereby the anchorage can be easily attached to a fixture (see e.g. UK Patent 1552667, 851981 and 1463589, French Patent 71.47446). The casing provides a fixed interior surface with which movable brake elements co-operate to provide the braking resistance required to prevent excessive pay-out speed of the cable. The spatial relationship of the casing to the interior mechanism is therefore fairly critical. Moreover the casing must be strong enough to sustain the multidirectional forces, which are imposed on it when the cable is loaded, and which are particularly large in the case of fall-arrest apparatus in the event that a fall occurs. These requirements significantly contribute to manufacturing cost and the total weight of the anchorage.

The present invention provides safety anchorages in which load and braking forces are sustained and transmitted in a way which is conducive to simplification of construction and to more efficient use of material used.

The invention incorporates safety anchorages having the features set out in claim 1 hereof. As stated therein, the anchorages are characterised in that the control assembly comprising the safety line carrier or guide and the brake mechanism which functions automatically to prevent excessive pay-out speed of the safety line when the anchorage is in use, are carried wholly or mainly by load-bearing means which is connected to the said assembly at a local region of its axial length. When the anchorage is in use, it is connected to a fixture. The anchorage has one or more attachment points for that purpose. Loading forces transmitted to the anchorage via the safety line, and braking forces, are transmitted to such attachment point(s) wholly or mainly along such spine.

Such safety anchorages can be compact and of relatively small weight. The use of load-bearing means in the form of a said spine is conducive to efficient use of the load-bearing material and to ease of assembly of the anchorage. The control assembly is preferably carried entirely or substantially entirely by the spine. The functioning of the anchorage is not dependent on the presence of a casing enclosing the control assembly. Indeed such a casing can be dispensed with.

It is most satisfactory for the spine to comprise a metal plate or a plurality of metal plates which extend(s) from the control assembly to the attachment point(s). Such plate(s) is (are) preferably flat so as to provide a substantially rectilinear load-transmitting path between the control assembly and the attachment point(s). However, depending on the weight distribution of the control assembly with respect to the region thereof at which the spine is connected to the assembly, it may be desirable for a part of the spine adjacent an attachment point to be angled with respect to the remaining major part of the spine in order that the anchorage, if suspended from a fixture by that attachment point, will hang in an upright position with the axis of rotation of the safety line carrier or guide horizontal.

The benefits of using a spine as aforesaid as load-bearing means are increased if the spine and the brake mechanism are positionally and functionally inter-related in accordance with further aspects of the invention as hereafter described.

The invention is particularly (although not exclusively) concerned with fall-arrest safety anchorages. Such anchorages according to the invention incorporate a safety line drum and braking means comprising relatively rotatable brake components which are permanently held in contact with each other or with (an) intervening friction ring(s). The anchorages also incorporate a centrifugal clutch which in the event that the unwinding speed of the drum exceeds a certain value functions automatically to cause relative rotation of such brake components. As a result of the frictional resistance to such relative rotation, the drum is thereby decelerated to rest. Such a brake mechanism is very reliable and is especially desirable in a fall-arrest safety anchorage for use by personnel. The forces which are imposed on the anchorage when a heavy falling load is arrested are large and if the safety line drum and brake mechanism are to be carried by a spine such as is hereinbefore referred to, their arrangement in relation to the spine is an important factor influencing the strength of the anchorage in relation to its weight.

According to one of the further aspects of the invention hereinbefore referred to, the invention provides fall-arrest safety anchorages as defined in claim 2 hereof. In such anchorages, there in a centrifugal clutch whose centrifuging coupling elements and co-operating abutments are disposed so that the torque resulting from engagement of the clutch is generated at least in part within the thickness of the spine. This feature favours efficient use of the material of the spine.

In particularly favoured embodiments of the invention, the or a spine plate actually constitutes a fixed brake component. Engagement of the clutch causes rotation of a rotatable brake component which is held under pressure against such spine plate or against a friction ring located between such brake component and such spine plate. Suitable friction braking material may be incorporated as an integral part of the said brake component or the spine or each of them in which case the interposition of one or more separate friction rings is not required.

The use of a spine plate as a brake component as above referred to affords an important advantage in terms of brake performance. The plate can promote rapid dissipation of heat which is frictionally generated on operation of the brake. Consequently, risk of distortion and malfunctioning of the brake is reduced and this enables relatively low melting and lighter weight materials to be used for the brake components. The temperatures to which the materials are raised depends of coure on the size of the frictioal contact areas. Preferably the frictional contact zone is between the spine plate and an outer peripheral margin of the rotatable brake component.

The benefits of the feature just described, according to which a spine plate is used as a brake component is not dependent on the the presence of the other feature earlier described, i.e. the arrangement of the co-operating clutch elements so that they engage wholly or partly within the thickness of the spine and the present invention includes anchorages wherein a spine plate serves as a brake component as aforesaid, irrespective of whether or not the anchorage also incorporates the said other feature. In the most advantageous embodiments of the invention the anchorage incorporates both of those features. The two features combine to give the best results in terms of the compactness of the anchorage, its strength/weight ratio, and the reliability of its braking system.

Instead of using a spine plate as a fixed brake component, the relatively rotatable brake components can be carried by the safety line drum, the centrifuging coupling elements of the clutch being displaceably carried by one of those brake components and the abutments with which such coupling elements co-operate being provided on the spine. Such alternative arrangement is however not so satisfactory.

The invention includes an anchorage of descent control kind wherein a safety line guide, e.g. a sheave, is connected to a centrifugal brake mechanism via an epicyclic gear train located within an aperture of a spine. The crown gear teeth can be formed directly in the spine or a separately fabricated ring gear can be fitted into the spine aperture. Such arrangement of the gear train also exploits the potential benefits of compactness and efficient force transmission which are attributable to the use of a spine as the load-bearing means.

The rotatable safety line carrier or guide of an anchorage according to the invention can carry or guide, or be designed for carrying or guiding, a cable or a safety line of some other form, e.g. a chain or a length of webbing.

Various embodiments of the invention, selected by way of example, will now be described with reference to the accompanying drawings, in which:

FIGS. 8 to 10 are sectional side elevations of three further brake assemblies;

FIG. 11 is a side sectional elevation of another safety anchorage according to the invention.

In the various drawings, corresponding parts in different figures are denoted by the same reference numerals.

Figure 1:
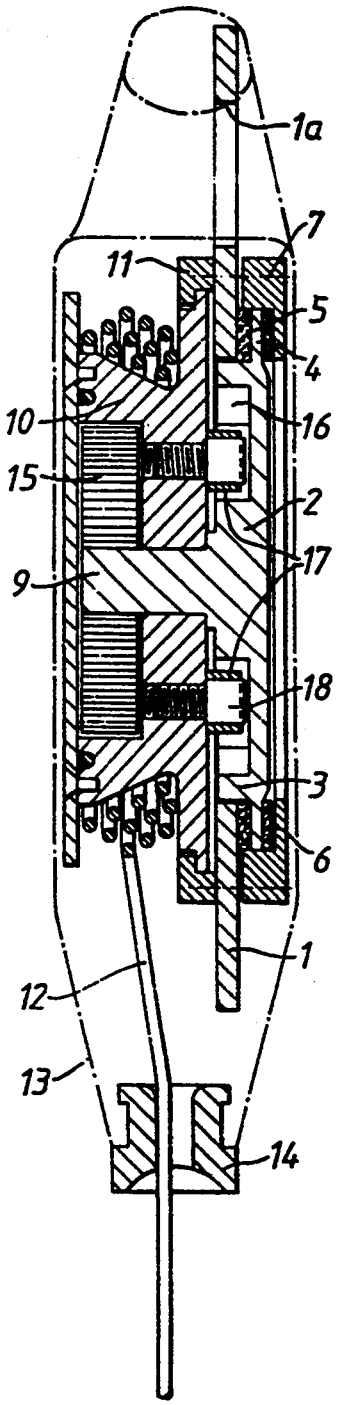
FIG. 1 is a sectional side elevation of a first form of safety anchorage according to the invention.
Figure 2:
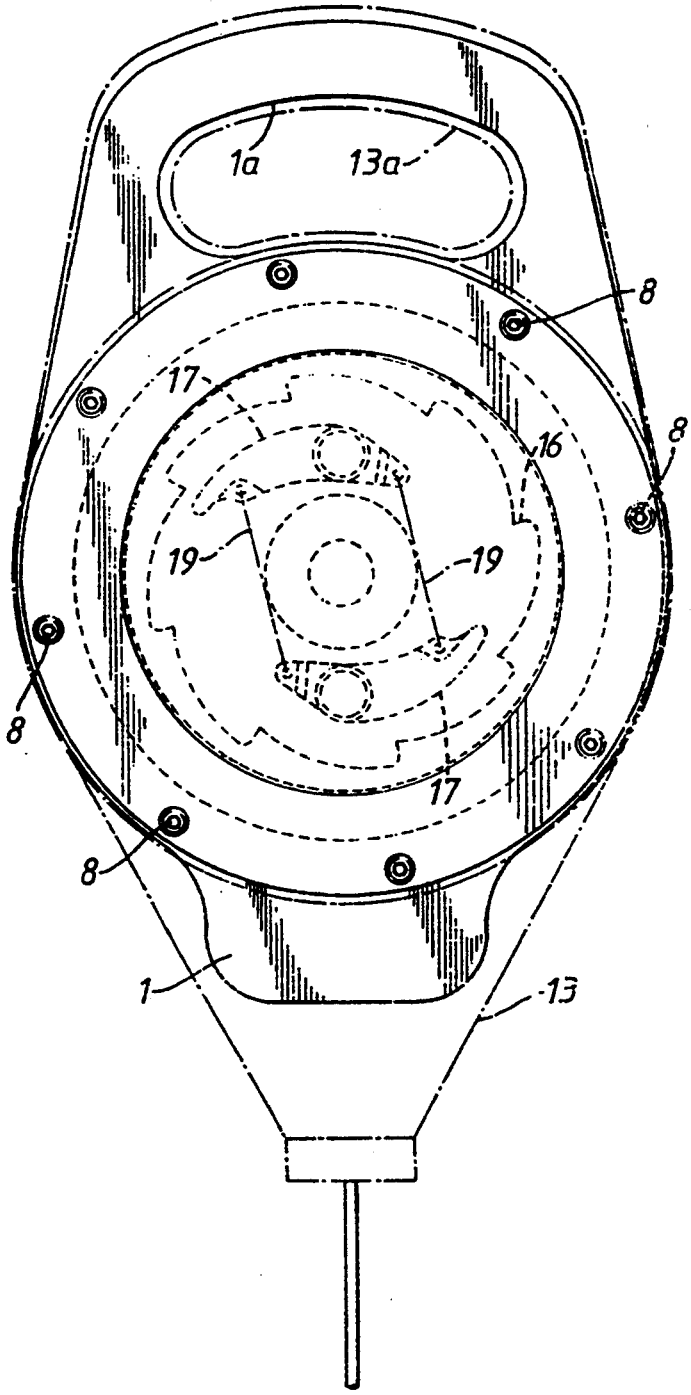
FIG. 2 is a front elevation of that anchorage.

The anchorage shown in FIGS. 1 and 2 comprises a spine plate 1 having in its top portion an aperture 1*a* by means of which the plate can be suspended from a fixture. A brake disc 2 has at one side thereof an an axially protruding annular rib 3 which intrudes into an aperture in the plate 1, The rib has a smooth exterior peripheral surface and make a close sliding fit in the said aperture so that the plate 1 serves as a bearing which supports the brake disc for rotation about its central axis. A peripheral margin of the disc 2 forms a radial flange 4 which overlaps a marginal portion of the plate 1 surrounding its said aperture. Brake rings 5,6 are located against the opposite faces of the flange 4 and these rings and the flange are held firmly together and against the spine plate by a clamping ring 7 which is secured to the spine plate 1 by bolts 8.

On the side of the brake disc 2 having the annular rib 3, the disc has a central spigot 9 forming a stub shaft on which a cable drum 10 is rotatably mounted. The drum is retained against axial displacement away from the spine plate by a retaining ring 11 which extends over a peripheral radial flange on one side wall of the drum and is bolted to the spine plate 1. A cable 12 is wound onto the drum. In this particular embodiment of the invention the spine plate and the cable drum and brake assembly which it carries are enclosed in a casing 13 in the top portion of which there is an opening 13*a* which registers with the aperture 1*a* in the spine plate. In the bottom of the casing there is a cable guide 14 through which the cable passes.

In use, the cable 12 is attached to a worker's safety belt or harness. Pull forces exerted on the cable due to normal movements of the worker cause the drum to rotate so that the necessary further length of cable is released and it does not restrain such movements. Such unwinding motion of the drum takes place against the action of a spiral spring 15 which is housed in a recess in the drum and is connected at one end to the drum and at the other end to the stub shaft 9. The spring serves automatically to rotate the drum in the winding direction when winding in of the cable is not restrained by the worker. Consequently, when the worker moves nearer the safety anchorage, the slack which would otherwise appear in the cable is automatically taken up.

Around the inside of the rib 3 on the brake disc 2 there is a series of abutments 16 which are in the form of ratchet teeth. The brake disc accordingly also constitutes a ratchet ring. The cable drum carries coupling elements 17 which are in the form of pawls for engaging the ratchet ring. The pawls are pivotally mounted on pins 18 which are screwed into the drum. The pawls are eccentrically mounted on the pins so that when the drum is rotating in the unwinding direction the centrifugal force on the pawls will tend to cause leading end portions of the pawls to swing outwardly into engagement with the ratchet ring. The pawls are biased against such movements by springs 19 so that they retain their inoperative positions during slow unwinding movements of the drum such as occur during normal pay-out of cable. If however the unwinding speed of the drum exceeds a certain value, due for example to the worker beginning to fall, the pawls swing into engagement with the teeth 16 of the ratchet ring and consequently force the brake disc 2 to rotate against the frictional resistance imposed by the brake assembly comprising the spine plate, the brake disc 2, the clamping ring 7 and the sandwiched brake rings 5, 6. This frictional resistance causes deceleration of the cable to zero. As the stub-shaft 9 rotates with the brake disc 2 and the inner end of the drum re-wind spring 15 is attached to that stub shaft, some of the tension in that spring will become released during such deceleration of the drum. In consequence when the load on the cable is eventually removed, the cable will not fully retract. The incomplete retraction gives an indication that the anchorage has arrested a fall and therefore need recertification before being reused.

The spine plate 1 is a fabrication separate from the casing of the anchorage. In fact, as will readily be apparent, the casing is not essential to the function of the mechanism and could be omitted. In that case, a cable guide such as 14, if required, could be carried by the spine plate. The spine member is connected to the control assembly at a region within the axial length of that assembly. The pawls and ratchet ring are arranged so they co-operate within the general plane of the spine. The forces imposed on the clutch and brake mechanism in the event of the clutch becoming engaged due to fall of a person attached to the cable are transmitted along the spine to the fixture from which the anchorage is suspended. The use of the spine plate 1 as a fixed brake component has the advantage that heat generated by friction when the brake is applied becomes quickly dissipated.

The anchorage represented in FIG. 3 differs from that shown in FIGS. 1 and 2 in the following respects: The anchorage has a brake disc/ratchet ring 22 which is keyed to a bush 23 which is rotatably mounted on a fixed shaft 24. The cable drum 10 is carried by a bearing ring 25 mounted on that shaft. The assembly comprising the cable drum, the brake mechanism, the bush 23, the bearing ring 25 and the shaft 24 on which they are mounted are carried by a spine comprising a lower plate 26 and an upper plate 27 which are connected together by bolts 28. The upper plate 27 has an aperture 27*a* by means of which the anchorage can be suspended from a fixture. The spine is therefore not quite in one plane, but it is substantially so. Like the spine of the anchorage according to FIGS. 1 and 2, the spine 26,27 of the anchorage according to FIG. 3 extends from the control assembly to an attachment point (provided by aperture 27*a*) which is located within the projected axial length occupied by the safety line drum and the brake mechanism. A metal strip 30 is connected to the spine by one of the bolts 28. This strip forms a bracket having a vertical limb which extends downwardly on the side of the cable drum 10 opposite the spine plate 26. The purpose of the bracket is to provide a fixing point for the corresponding end of the shaft. The end of the shaft is of a flattened section and projects through a slot in the strip 30 which therefore prevents the shaft from rotating. The shaft is retained against axial displacement relative to the drum and brake assembly by pins 31,32. The bracket 30 need not provide more than a balancing support for the shaft 24 and the parts which it carries. In use, the weight of those parts and the forces imposed on them when the clutch becomes engaged due to acceleration of the drum under the action of a falling load are transmitted to the fixture wholly or mainly by the spine. The anchorage has a casing 13 but it is not required to have any load-bearing properties.

Figure 3:
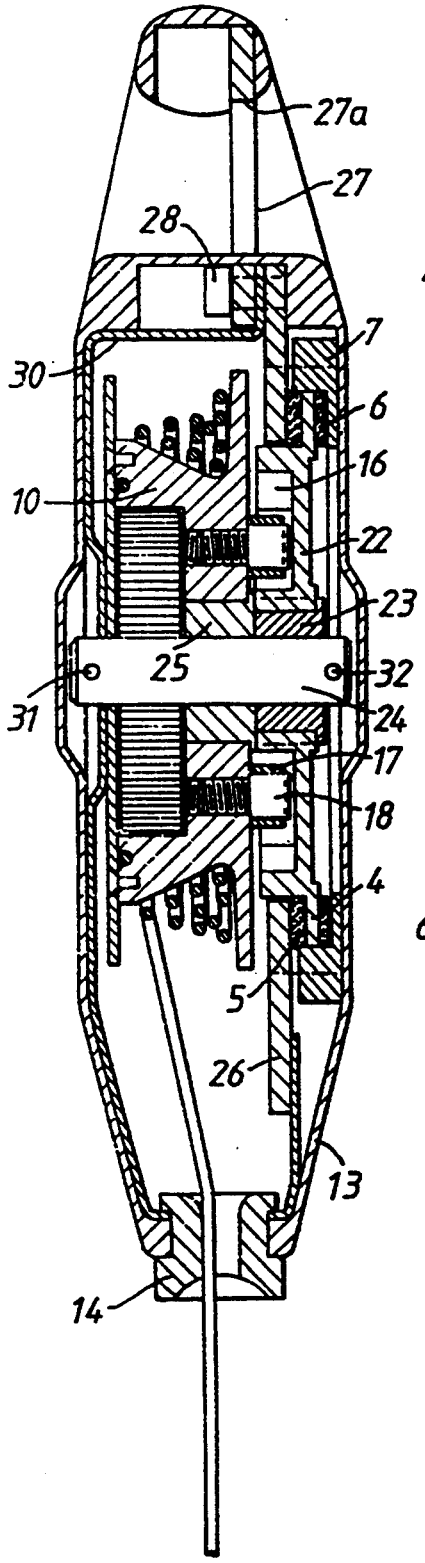
FIGS. 3 to 5 are sectional side elevations of second, third and fourth forms of safety anchorages according to the invention.
Figure 4:
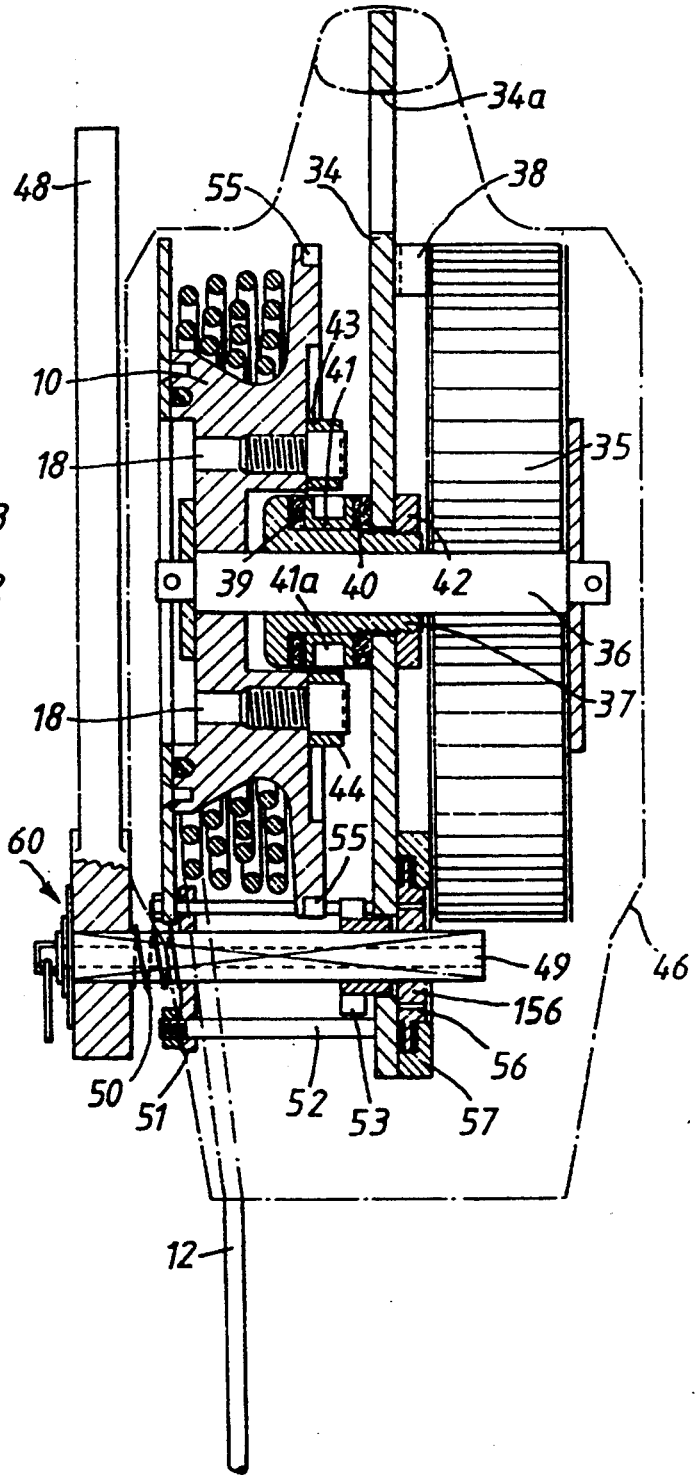

Reference is now made to FIG. 4. This Figure shows a fall-arrest device wherein the cable drum 10 and brake mechanism are mounted at one side of a spine plate 34 and a drum re-wind spring 35 is mounted at the opposite side of such plate. The drum is secured to a shaft 36. The shaft is rotatable in a flanged bearing bush 37 which extends through the spine plate. The inner end of the re-wind spring is connected to the shaft whereas the outer end of the spring is connected to the spine plate by a connector 38. The bearing bush 37 carries friction brake rings 39, 40 and a brake ring 41. A clamping nut 42 is screwed onto the bearing bush 37 and tightened against the spine plate 34 so as to clamp the brake rings 39–41 together between the flange of bush and the spine plate. The brake ring 41 forms part of a centrifugal clutch and for this purpose has a peripheral series of ratchet teeth 41*a* for engagement by eccentrically mounted pawls 43, 44 which are pivotally mounted on the drum by means of studs 18. If the unwinding speed of the drum exceeds a certain value, the pawls undergo pivotal movement under centrifugal force, against the action of biasing springs (not shown). The longer arms of the pawls swing outwardly whereas their shorter arms swing inwardly into engagement with the ratchet teeth 41*a* of brake ring 41. The braking action is therefore similar to that of the brake mechanism of the fall-arrest devices shown in FIGS. 1–3. The device has a casing 46 but this is optional.

In the top of the spine plate 34 there is an aperture 34*a* which facilitates connection of the spine to a fixture. When the device is in use, its weight and any loading forces imposed thereon via the cable 12 are transmitted to the fixture along the spine plate.

Instead of providing an aperture in the spine plate 34 for forming an attachment point, an attachment point can be provided by attachment means, e.g. a shackle, connected to the top of such plate.

The device shown in FIG. 4 is provided with a winch mechanism by means of which a body suspended from the cable 12 can be safely winched up or down. The winch mechanism comprises a winch handle 48 which is mounted on a square section shaft 49. The handle is shown in an inoperative position which it occupies when the winch mechanism is not required for use. In this inoperative position the handle lies close to the casing 46. The handle, with its shaft, is held in this depressed position by a catch (not shown) against the force exerted by a compression spring 50 located between the handle and a shaft supporting bracket 51 which is secured to the spine plate by tie bolts 52. A pinion 53 is secured on the shaft 49. When the handle catch is released the spring 50 displaces the shaft and handle into an operative position in which the handle is spaced from the casing and the pinion 53 meshes with teeth 55 on the adjacent flange of the cable drum 10. The winch mechanism has an associated brake mechanism comprising a disc 156 carrying spring-loaded pawls, which is mounted on the square-section shaft 49 with a sliding fit, and a ratchet ring 56. The ring 56 has a peripheral flange which is sandwiched between friction brake rings. These rings are clamped against that flange by a clamping ring 57 under pressure exerted by bolts (not shown) which connect that ring to the spine plate 34. Within the hub portion 60 of the winch handle there is a reversible ratchet device which by means of a selector lever can be set for transmitting rotary motion to the shaft 49 on either clockwise or anti-clockwise movement of the winch handle around the axis of the shaft. Depending on the setting of that selector lever, rocking motion of the winch handle causes step-wise winding or unwinding motion of the cable drum. Due to the large mechanical advantage afforded by the winch mechanism, a person attached to the cable 12 can easily be raised. If, prior to operation of the winch, the person has sustained a fall, the pawls 43, 44 of the centrifugal clutch will be held in engagement with the ratchet teeth 42 under the torque imposed on the cable drum by the load on the cable, but as soon as the winch is operated to begin raising of the person to a recovery point at a higher level, the pawls 43, 44 will become retracted out of engagement with the brake ring 41. However, unwinding of the cable under the suspended load will be prevented by the frictional resistance of the winch brake due to the engagement of the pawls of the pawl-carrying disc 156 with the ratchet ring 56. That ratchet mechanism allows the rotation of the drum and disc 156 in the cable winding direction to take place relative to the ratchet ring 56 and the winching-up movements of the cable drum therefore take place free from any such frictional resistance of the winch brake. If the winch is operated to lower the person to a recovery point at a lower level, the stepwise unwinding motion of the drum takes place against the combined resistances of the cable drum brake and the winch brake. However, the load imposed by the suspended person assists the unwinding motion and the force which has to be exerted on the winch handle is relatively small. Fall-arrest devices incorporating a winch mechanism with an associated winch brake as shown in FIG. 4 are the subject of co-pending UK Patent Application No. 9023703.3 filed Oct. 31, 1990.

Figure 5:
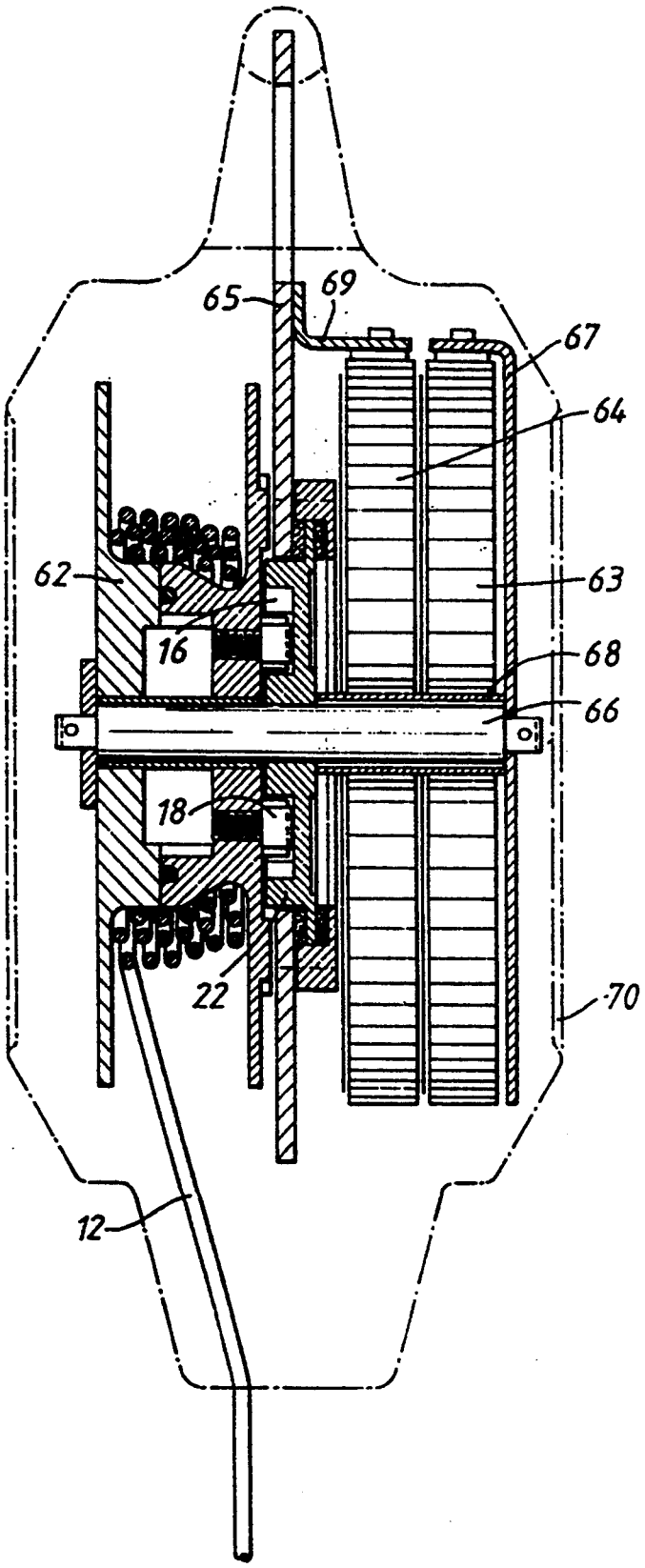

FIG. 5 shows a fall-arrest device in which a cable drum, a drum brake a centrifugal clutch mechanism and a central shaft are assembled to a spine in a manner similar to the corresponding parts in FIG. 3. The device shown in FIG. 5 differs from that shown in FIG. 3 only in the following respects. The cable drum 62 does not house a re-wind spring. Automatic re-wind is effected by two series-connected springs 63, 64 which are disposed on the opposite side of the spine 65. The spine is formed by a single plate. The cable drum is secured to the shaft 66 which is rotatable in a bearing formed by the brake disc 22 which forms part of the centrifugal clutch. The outer end of spiral spring 63 is connected to the shaft 66 by a connecting plate 67 whereas the inner end of that spring is connected by a core element 68 to the inner end of spring 64. The outer end of spring 64 is connected to the spine 65 by bracket 69. A casing 70 is provided but it is not essential. All the other parts are carried by the spine.

Figure 8:
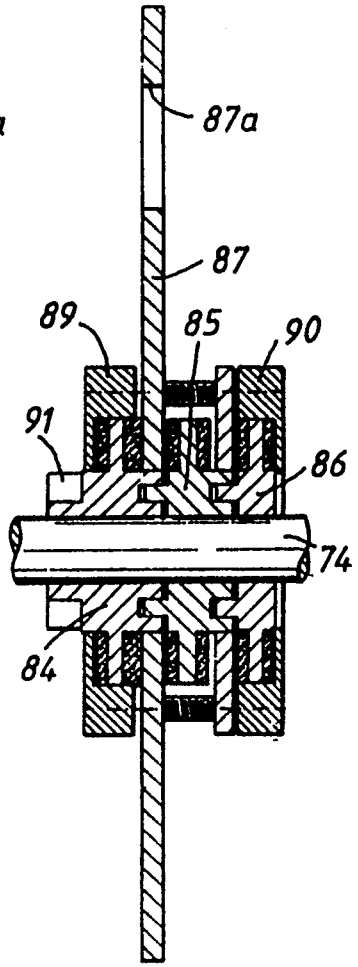
Figure 7:
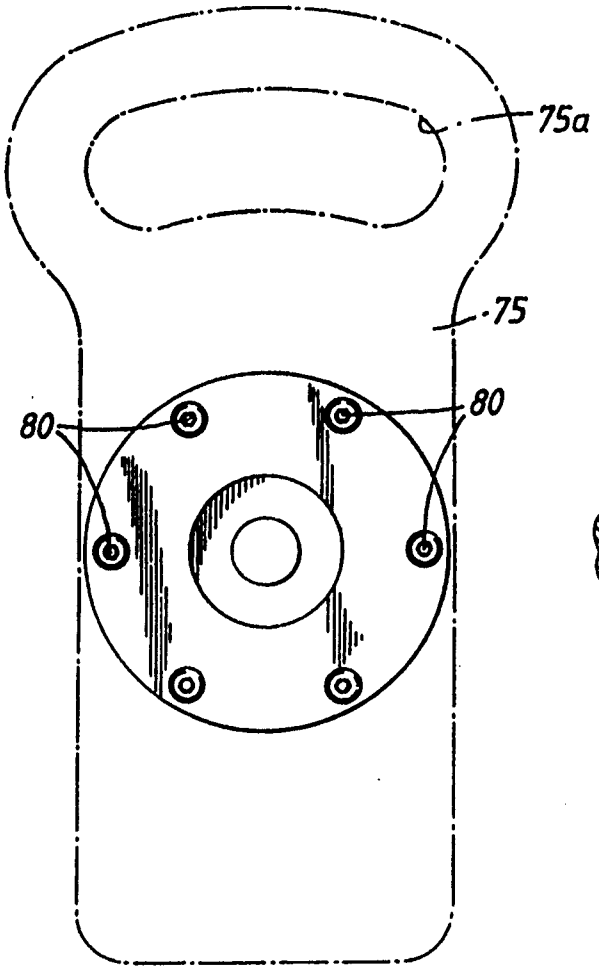
FIG. 7 is a front elevation of the assembly shown in FIG. 6.
Figure 6:
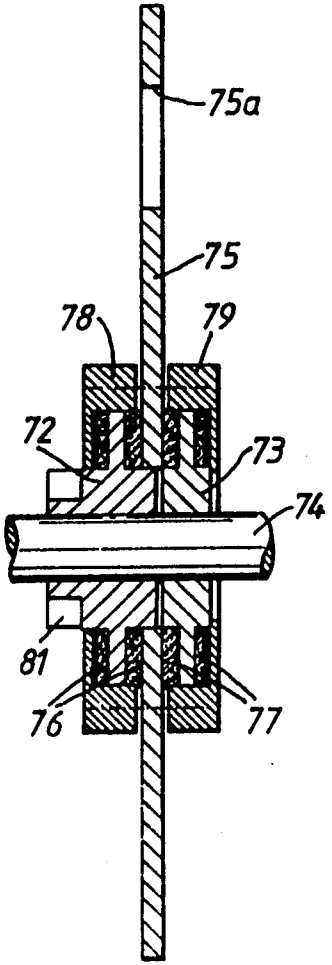
FIG. 6 is a sectional side elevation of a brake assembly.

FIGS. 6–8 show different forms of spine and brake component assemblies which can be incorporated in devices according to the invention. FIGS. 6 and 7 show an assembly wherein there are two brake discs, 72–73. These discs are rotatable about the shaft 74 (which will carry a cable drum or sheave). The brake discs 72, 73 have hub portions which make a close running fit in a hole in the spine 75, which has an aperture 75*a* permitting its suspension from a fixture. The peripheral flanges of the brake discs 72, 73 lie on opposite sides of the spine and are sandwiched between brake ring pairs 76, 77. The brake discs and rings are clamped together and against the spine by clamping rings 78, 79 which are connected to the spine by bolts at positions 80 around indicated in FIG. 7. The brake disc 72 is formed with a series of ratchet teeth 81 so that it can form part of a centrifugal clutch functioning in the same way as the toothed brake ring 41 in the fall-arrest device shown in FIG. 4.

The assembly shown in FIG. 8 incorporates three brake discs 84–86 which are rotatable on shaft 74. Each of those brake discs has two associated friction brake rings associated therewith in the same way as the brake discs 72 and 73 in FIG. 6. The brake discs are formed with annular ribs and grooves by means of which they are connected in nested relationship for rotation as a unit. The brake discs and rings are distributed to opposite sides of the spine plate 87 which carries the brake assembly and will also carry a cable drum or sheave. The plate has an aperture 87*a* so that it can be suspended from a fixture. A plate 88 is interposed between the friction brake rings associated with discs 85 and 86. The brake element assembly is held together under clamping force exerted by bolts (not shown) which connect clamping rings 89,90 to the spine plate. The brake disc 84 has ratchet teeth 91 so that it can serve as a centrifugal clutch component in the same way as disc 72 in FIG. 6.

Figure 9:
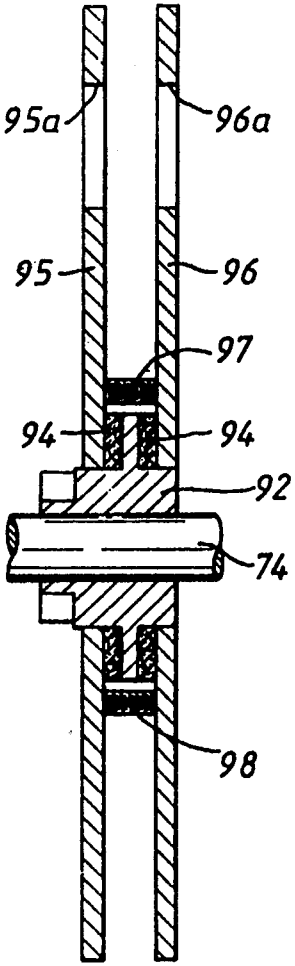

The assembly shown in FIG. 9 comprises a brake disc 92 whose peripheral flange is disposed between a pair of brake rings 94. These rings are sandwiched between the said flange and parallel plates 95,96 which together form the spine which carries the shaft 74, the brake assembly and a cable drum or sheave. The spine plates have apertures 95*a*,96*a* to form a suspension loop. They are clamped against the friction rings by threaded fasteners such as 97,98.

Another assembly incorporating a twin-plate spine for carrying the brake assembly and a cable drum or sheave is shown in FIG. 10. In this assembly a brake disc 102, has ratchet teeth 103 on one side and a spigot portion 104 on the opposite side. Two further brake discs 105, 106 are mounted on that spigot portion so that the three bake discs are rotatable as a unit about the shaft 74. The upper portion of the spine has apertures 100*a*,101*a* and forms a suspension loop. The spine plates are located between the outer brake discs and the middle one so that the assembly is substantially symmetrical with respect to the planes of those plates. The friction brake rings, the brake discs and the spine plates are held clamped together by threaded fasteners such as 107, 108 which connect opposed clamping rings 109 and 110.

FIG. 11 shows another fall-arrest device according to the invention. In this anchorage, a cable drum 128 together with an associated brake mechanism and centrifugal clutch are disposed on one side of a spine plate 129 and a rewind spring 130 is disposed on the opposite side of that plate. To that extent the assembly is similar to that in the anchorage shown in FIG. 4. However, in the anchorage shown in FIG. 11, the ratchet teeth 131 of the centrifugal clutch are formed on the inner periphery of a ring 132. The flange 133 of that ring is located within the projected width of those teeth. Friction brake rings 134, 135 are sandwiched under pressure between the flange 133 and the fixed brake components, one of which is constituted by the spine plate 129. The spine 129, which has a top loop 129*a* providing an attachment point for attachment of the anchorage to a fixture, directly serves as a bearing for the shaft 136 which carries the drum 128 and rotates therewith.

Figure 13:
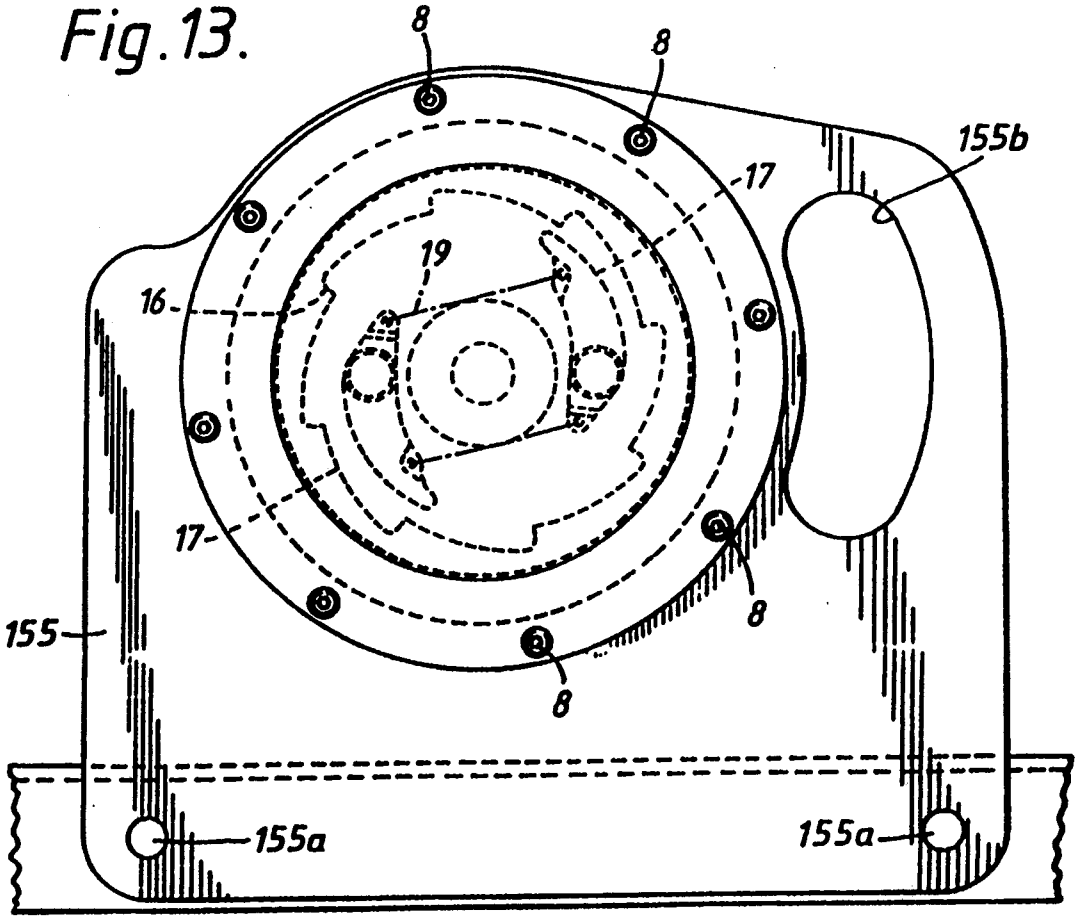
FIGS. 12 and 13 are side sectional and front elevations respectively of an anchorage designed for bolting to a fixture.
Figure 12:
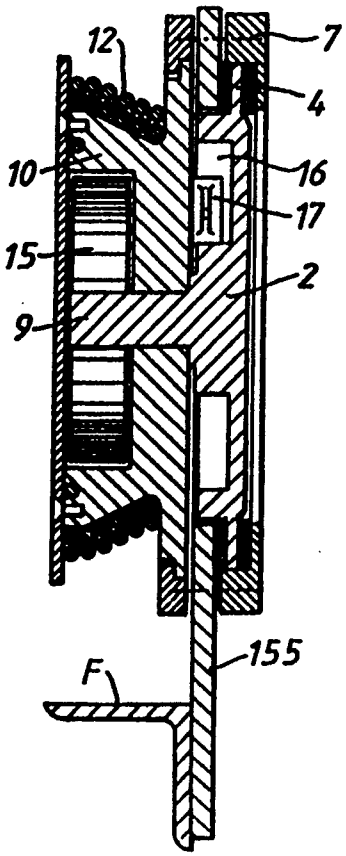

FIGS. 12 and 13 show an anchorage having a spine 155 formed by a plate for rigid attachment to a fixture. For this purpose the plate has holes 155*a* for the passage of securing bolts by which the anchorage can be bolted to a fixture such as F. The anchorage can be secured in different orientations to suit different circumstances. Thus, the anchorage can be bolted to a vertical fixture surface disposed alongside the anchorage so that the spine plate 155 extends cantilever fashion from such fixture. FIG. 15 can be regarded as a plan view of the anchorage as thus installed. As an alternative the spine plate can be bolted to an overhead vertical fixture surface so that the plate extends downwardly therefrom. In a portion of the plate other than that at which the holes 155*a* are provided, it has an aperture 155*b* so as to provide an attachment loop by which the anchorage can be suspended, e.g. from a hook or other coupling element on a fixture. In whichever of those ways the anchorage is attached to a fixture, the spine provides a rectilinear load-transmitting path between the control assembly and the attachment point or points. 0f course the anchorage (and indeed other anchorages according to the invention) can if required be suspended from a crane or other lifting gear instead of being attached to a fixture. The cable drum and brake mechanism of the anchorage shown in FIGS. 12 and 13, and their assembly to the spine, are similar to those of the anchorage shown in FIGS. 1 and 2 and therefore require no further description. Corresponding parts in tile different figures bear the same reference numerals.

I claim:

1. A fall-arrest safety anchorage comprising:

a load bearing spine means (34, 75, 87, 95, 109, 129) having at least one attachment point (34*a*; 75*a*; 87*a*; 95*a*; 100*a*; 129*a*;) by which it can be attached to a fixture, a rotatable shaft (36, 74, 136) and a drum (10,128) integral with the shaft from which drum a safety line wound thereon can be drawn in response to a pulling force on that line exerted by a falling body attached thereto, braking means which functions automatically to arrest rotation of the shaft and drum if the unwinding speed of the drum exceeds a predetermined value, said braking means including a rotatable brake component (41; 72; 73; 84; 86; 92; 102; 132) which is connected to said drum by a centrifugal clutch which is mounted on said drum (41–41*a*, 44; 131–132), means (5–6; 39–40; 76; 94; 134–135) which imparts frictional resistance to rotation of said rotatable brake component relative to a fixed brake component (34,37; 75,78; 87,89; 95,96; 100,109; 129;) of the anchorage, wherein the shaft,the drum, the safety-line and said braking means are carried by said load-bearing spine means, which spine means consists of a single spine plate having an opening in which said shaft is supported for rotation, said rotatable brake component and said drum being located on one side of said spine plate, and one rewind spring connected between the spine plate and the shaft being located at the opposite side of the spine plate, said spine plate serving as the fixed brake component and thus serving to transmit all load and braking forces operating on said spine plate to said at least one attachment point, and said spine plate being independent of a casing for enclosing said shaft, drum and braking means.

2. A fall-arrest safety anchorage according to claim 1, wherein the rotatable brake component (102; 132) has a series of abutments (103, 131) which surround and are engageable by centrifuging coupling elements of the centrifugal clutch and said frictional resistance means is between said spine plate and an outer peripheral margin of said rotatable brake component, surrounding said series of abutments.

3. A safety anchorage according to claim 2, wherein said rotatable brake component (72; 84) is one of a plurality of rotatable brake discs (72–73; 84–86; 102,105,106) which rotate as a unit on engagement of said centrifugal clutch, and wherein brake rings (76,77) impart frictional resistance to rotation of the rotatable brake discs are present between each of such rotatable brake discs and a fixed brake component (75; 87,88; 100,101).

4. A safety anchorage according to claim 3, wherein said frictional resistance means comprises a pair of friction rings and each of the rings is held sandwiched under pressure between relatively rotatable and fixed brake components.

5. A safety anchorage according to claim 2, wherein said frictional resistance means; comprises at least one friction ring which is held sandwiched under pressure between said relatively rotatable break component and fixed brake component.

6. A safety anchorage according to claim 2, wherein said frictional resistance means comprises a pair of friction rings which are held sandwiched under pressure between relatively rotatable brake component and fixed brake component.

7. A safety anchorage according to claim 1, wherein said rotatable brake component (72; 84) is one of a plurality of rotatable brake discs (71–73; 84–86; 102,105,106) which rotate as a unit on engagement of said centrifugal clutch, and wherein brake rings (76,77) impart frictional resistance to rotation of the rotatable brake discs are present between each of such rotatable brake discs and a fixed brake component (75; 87,88; 100,101).

8. A safety anchorage according to claim 7, wherein said frictional resistance means; comprises a pair of friction rings which are held sandwiched under pressure between relatively rotatable brake discs and fixed brake component.

9. A safety anchorage according to claim 1, wherein said frictional resistance means comprises at least one friction ring which is held sandwiched under pressure between said relatively rotatable brake component and said fixed brake component.

10. A safety anchorage according to claim 1, wherein said frictional resistance means comprises a pair of friction rings which are held sandwiched under pressure between relatively rotatable brake component and fixed brake component.

11. A fall-arrest safety anchorage comprising:

load bearing spine means (34; 65; 75; 87; 95; 100–101; 129), having at least one attachment point (34*a*;

65*a*; 75*a*; 87*a*; 95*a*; 100*a*; 129*a*) by which it can be attached to a fixture;

a rotatable shaft (36,74,136) and safety line drum (10,128) integral with the shaft from which drum a line wound thereon can be drawn in response to a pulling force on that line exerted by a body attached thereto, braking means for arresting rotation of the shaft and safety line drum, said braking means including a fixed brake component and relatively rotatable brake components, means (39,40; 76,77; 94,95; 134,135) for imparting frictional resistance to rotation between said fixed brake component and the relatively rotation between said fixed brake component and the relatively rotatable brake components, said relatively rotatable brake components comprising clutch means (41,41*a*,44; 131,132) which functions automatically to cause relative rotation of the relatively rotatable brake components against said frictional resistance means on rapid acceleration of the shaft and safety line drum such as occurs in the event of a fall of a person attached to the line, said clutch means including coupling elements (44; 132) which are pivotally mounted to the safety line drum, and abutments (44*a*; 131) with which said coupling elements move into engagement under said rapid acceleration so as to bring about the relative rotation of the brake components, said shaft and safety-line drum and said relatively rotatable brake components are supported for rotation by an opening provided in the load-bearing spine means, said shaft being supported for rotation in said opening, said load-bearing spine means consisting of one spine plate (34; 75; 87; 129) with functions as said fixed brake component, said coupling elements (44,132), abutments (44*a*,131) and drum being located at one side of the spine plate, and one rewind spring connected between the spine plate and the shaft being located at the opposite side of the spine plate, and said spine plate serving to transmit load and braking forces operating on the safety anchorage to said at least one attachment point.

12. A safety anchorage according to claim 11, wherein said rotatable brake components are a plurality of rotatable brake discs (72–73; 84–86; 102,105,106) which rotate as a unit on engagement of said clutch means, and wherein said means (76,77) which imparts frictional resistance to rotation of such rotatable brake discs is present between each of such rotatable brake discs and a fixed brake component (75; 87,88; 100,101).

13. A fall-arrest safety anchorage according to claim 11, wherein at least one of the rotatable brake components (102; 132) has a series of abutments (103,131) engageable by said coupling elements (17) of the clutch means and said frictional resistance means is between said spine plate and an outer peripheral margin of a rotatable brake component, surrounding such series of abutments.

14. A safety anchorage according to claim 13, wherein said rotatable brake components are a plurality of rotatable brake discs (72–73; 84–86; 102,105,106) which rotate as a unit on engagement of said clutch means, and wherein said means (76,77) which imparts frictional resistance to rotation of such rotatable brake discs is present between each of such rotatable brake discs and a brake component (75; 87,88; 100,101).

15. A safety anchorage according to claim 13, wherein said means imparting frictional resistance comprises at least one friction ring which is held sandwiched under pressure between said relatively rotatable brake components and fixed brake components.

16. A safety anchorage according to claim 11, wherein said means imparting frictional resistance 39–40; 76; 94; 134–135) comprises at least one friction ring which is held sandwiched under pressure between a relatively rotatable and a fixed brake component.

17. A fall-arrest safety anchorage comprising:

load bearing spine means (95–96; 100–101), having attachment points (95*a*,96*a*; 100*a*,101*a*) by which it can be attached to a fixture;

a rotatable shaft (74) and safety line drum integral with the shaft from which drum a line wound thereon can be drawn in response to a pulling force on that line exerted by a body attached thereto, braking means for arresting rotation of the shaft and safety line drum, said braking means including fixed brake components and relatively rotatable brake components, means for imparting frictional resistance to rotation between the fixed brake components and the relatively rotatable brake components, said relatively rotatable brake components comprising clutch means which functions automatically to cause relative rotation of the relatively rotatable brake components against said frictional resistance means on rapid acceleration of the shaft and safety line drum such as occurs in the event of a fall of a person attached to the line, said clutch means including coupling elements which are pivotally mounted to the safety line drum, and abutments with which said coupling elements move into engagement under said rapid acceleration so as to bring about the relative rotation of the brake components, said shaft and safety-line drum and said relatively rotatable brake components are supported for rotation by openings provided in the load-bearing spine means, said shaft being supported for rotation in said openings, said load-bearing spine means including a pair of identical spine plates which function as said fixed brake components, said frictional resistance means comprises a brake having a flange disposed between and in frictional contact with a pair of brake rings sandwiched between said pair of spine plates, and said pair of spine plates serving as said fixed brake components, said coupling elements, abutments, and drum being located at one side of the spine means, and said spine plates serving to transmit load and braking forces operating on the safety anchorage to said at attachment points.

* * * * *